US006746380B2

(12) United States Patent
Lien et al.

(10) Patent No.: US 6,746,380 B2
(45) Date of Patent: Jun. 8, 2004

(54) WEIGHT PLATE

(75) Inventors: Louis Lien, Bellaire, TX (US); Annie Wu, Houston, TX (US); Robert Tanko, Humble, TX (US); Eugene Segovia, Bellville, TX (US); Rick Byrd, Springfield, MD (US); Robert E. Harms, Houston, TX (US)

(73) Assignee: USA Sports, Inc., Houston, TX (US)

( * ) Notice: Subject to any disclaimer, the term of this patent is extended or adjusted under 35 U.S.C. 154(b) by 0 days.

(21) Appl. No.: 09/758,770

(22) Filed: Jan. 11, 2001

(65) Prior Publication Data

US 2002/0091044 A1 Jul. 11, 2002

(Under 37 CFR 1.47)

(51) Int. Cl.[7] ..... A63B 21/072; A63B 21/06
(52) U.S. Cl. ..... 482/106; 482/93
(58) Field of Search ..... 482/93, 106, 107, 482/108; D21/679, 680, 681, 682, 683, 684

(56) References Cited

U.S. PATENT DOCUMENTS

| | | | |
|---|---|---|---|
| 1,047,212 | A | 12/1912 | Hamilton |
| 2,244,351 | A | 6/1941 | Venables |
| 2,447,218 | A | 8/1948 | Trzesniewski |
| 2,676,802 | A | 4/1954 | O'Brien |
| 2,796,269 | A | 6/1957 | Watson |
| D194,042 | S | 11/1962 | Guthormsen |
| 3,171,652 | A | 3/1965 | Newman |
| 3,226,117 | A | 12/1965 | Walklet |
| 3,482,835 | A | 12/1969 | Dean |
| D216,517 | S | 1/1970 | Dorn |
| 3,572,702 | A | 3/1971 | Dorn |
| 3,771,785 | A | 11/1973 | Speyer |
| 3,796,431 | A | 3/1974 | Sinyard |
| 3,913,908 | A | 10/1975 | Speyer |
| 3,971,555 | A | 7/1976 | Mahnke |
| 4,079,932 | A | 3/1978 | Schuetz |
| 4,231,569 | A | 11/1980 | Rae |
| 4,311,306 | A | 1/1982 | Solloway |
| 4,369,968 | A | 1/1983 | Price |
| 4,373,717 | A | 2/1983 | Lambert, Jr. |
| D274,283 | S | 6/1984 | Wright |
| 4,455,020 | A | 6/1984 | Schnell |
| 4,482,151 | A | 11/1984 | Zwilling |
| D278,358 | S | 4/1985 | Zwilling |
| 4,515,364 | A | 5/1985 | Rotella |
| 4,625,959 | A | 12/1986 | Schleffendorf |
| 4,673,179 | A | 6/1987 | Pengler |
| 4,756,526 | A | 7/1988 | Broussard |
| 4,817,944 | A | 4/1989 | Anderson et al. |
| 4,828,256 | A | 5/1989 | Lee et al. |
| 4,854,575 | A | 8/1989 | Wilson et al. |
| 4,880,229 | A | 11/1989 | Broussard |
| D309,763 | S | 8/1990 | Solloway |

(List continued on next page.)

*Primary Examiner*—Nicholas D. Lucchesi
*Assistant Examiner*—Fenn C Mathew
(74) *Attorney, Agent, or Firm*—Wong, Cabello, Lutsch, Rutherford & Brucculeri L.L.P.

(57) ABSTRACT

An improved weight plate includes a planar body having a central opening for receiving a barbell or dumbbell bar therethrough. The weight plate includes oppositely facing flange members extending partially about the perimeter of the weight plate. The opposed ends of the flange members are spaced from each other and define a gap therebetween. The flange members extend perpendicularly from both sides of the weight plate planar body about the perimeter thereof. The weight plate includes at least one opening formed adjacent the perimeter of the weight plate. The opening is adapted to receive one or more fingers of an average human hand for securely grasping and lifting the weight plate. Adjacent weight plates mounted on a barbell bar are adapted for interlocking engagement.

18 Claims, 4 Drawing Sheets

U.S. PATENT DOCUMENTS

| | | | | | |
|---|---|---|---|---|---|
| 5,137,502 | A | | 8/1992 | Assatasi | |
| 5,344,375 | A | | 9/1994 | Cooper | |
| D355,007 | S | | 1/1995 | Rojas et al. | |
| 5,464,379 | A | | 11/1995 | Zarecky | |
| 5,573,484 | A | | 11/1996 | Carpenter | |
| D377,202 | S | | 1/1997 | Rohan | |
| D394,685 | S | | 5/1998 | Eckmann | |
| 5,853,355 | A | * | 12/1998 | Standish | 482/106 |
| D405,484 | S | | 2/1999 | Rojas et al. | |
| D406,183 | S | | 2/1999 | Zovich | |
| D409,266 | S | | 5/1999 | Rojas et al. | |
| D421,076 | S | | 2/2000 | Lincir | |
| D424,639 | S | * | 5/2000 | Rojas et al. | D21/680 |
| D428,947 | S | | 8/2000 | Harms et al. | |
| D433,721 | S | | 11/2000 | Rojas et al. | |
| D434,090 | S | | 11/2000 | Wallace et al. | |
| D448,055 | S | * | 9/2001 | Lien et al. | D21/680 |
| 6,319,176 | B1 | * | 11/2001 | Landfair | 482/106 |
| 6,328,678 | B1 | * | 12/2001 | Romero | 482/106 |
| 6,436,015 | B1 | | 8/2002 | Frasco et al. | |

* cited by examiner 28
40
30
21
22
32
50
14
26
31
23
33

WEIGHT PLATE

BACKGROUND OF THE DISCLOSURE

The present invention relates generally to physical fitness equipment, particularly to weight plates which may be used during weight lifting.

The physical fitness industry has seen tremendous growth during the past couple of decades. A wide array of exercise apparatus is available to meet the needs of a growing population of consumers engaged in physical fitness activities. Some of the new exercise apparatus include high tech interactive features which can display sophisticated graphics and information for engaging and holding the attention of the user while he exercises. Little has changed however in the area of free weight exercises.

Free weight exercises generally require weight plates for use with barbells and dumbbells. The weight plates are typically disc-shaped and include a center opening for receiving a barbell or dumbbell bar through the opening. Generally, a retention collar mounted onto the barbell or dumbbell bar retains the weight plate on the bar. In some instances, particularly for dumbbells, the weight plates may be fixed to the weight bar.

One major problem with free weight lifting and a cause of many accidental injuries is that it is difficult to pick up a weight plate, particularly disc-shaped plates having flat sides. Most users can typically handle the lighter weights of 5 or 10 pounds without too much difficulty. But as the size and weight of the weight plate increases one must be very careful to avoid injury. The problem, simply stated, is that a flat sided weight plate does not have a convenient hand hold to be grasped by the user for lifting it off a flat surface, such as a floor or a stack of weight plates. Lifting a typical weight plate off of a flat surface requires that the user apply sufficient radial and frictional force on the periphery or outer perimeter of the disc-shaped plate to lift at least one side of the plate a sufficient distance off the flat surface to permit the user to place his fingers around the periphery and onto one of the flat surfaces of the plate. Of course, the heavier the weight plate, the more difficult the lifting maneuver becomes. Lifting a weight plate employing the generally accepted method described above can cause injury by slipping out of the grasp of the user and falling on toes or finger tips.

Some weight plates include a flat surface on one side and an upstanding circumferential flange about the periphery of the opposite or second flat side of the plate. This provides a raised surface which may be gripped for lifting the weight plate when it is lying on its flat side. The same problem is encountered, however, when an individual attempts to lift the weight by the circumferential flange. A sufficient radial and frictional force must still be applied to lift the plate on its peripheral edge so that the individual can grip the plate by wrapping his fingers and thumb about the upstanding flange and outer edge of the weight plate.

The problems noted above are not encountered solely when exercising with free weights. Many exercise apparatus require that weight plates be added or removed to vary the resistance provided by the exercise apparatus. The typical weight plate is not only difficult to lift off a flat surface as noted above, but also difficult to hold and raise it up, perhaps to chest level, to mount the weight plate on an exercise apparatus. Likewise, removing a weight plate from a relatively high position on an exercise apparatus is also difficult and if not done with care may result in injury to the individual removing the weight plate.

Another problem associated with weight plates having a circumferential upstanding flange on one or both sides of the weight plate, is that the weight plates mounted on the weight bar are not in facing contact. The weight plates typically contact each other only at the flanges and are free to rotate about the weight bar relative to each other.

It is therefore an object of the present invention to provide a weight plate which may be securely gripped and moved from one location to another without regard to its position relative to a flat support surface or the like.

It is another object of the present invention to provide a weight plate that includes at least one notch formed in a perimeter flange providing access for engaging a flat surface of the weight plate and applying an axial force to lift the weight plate off a flat support surface.

It is also an object of the present invention to provide a weight plate having at least one opening formed in the weight plate body near the circumferential edge thereof. The openings is sized to permit an individual's fingers to extend through the opening with the thumb wrapped around the edge of the weight plate for lifting the weight plate.

It is still another object of the present invention to provide a weight plate adapted for interlocking engagement with an adjacent weight plate mounted on a weight bar.

SUMMARY OF THE INVENTION

In accordance with the present invention, an improved weight plate is provided that is easily moved from a flat support surface. The weight plate includes a planar body having a central opening for receiving a barbell or dumbbell bar therethrough. Oppositely facing flange members extend partially about the perimeter of the weight plate. The opposed ends of the flange members are spaced from each other and define a gap therebetween. The flange members extend perpendicularly from both sides of the weight plate planar body about the perimeter thereof. The flange members project in opposite directions from the planar body of the weight plate a sufficient distance to permit at least one finger of an average human hand to extend through the gap separating the ends of the flange members for applying an axial force on the bottom planar surface of the weight plate. For example, FIG. 2 shows a weight plate having opening 40 and FIG. 8 shows the same weight plate have three openings, 40, 41, and 42.

The weight plate includes at least one grip opening formed adjacent the peripheral edge of the weight plate. The opening is adapted to receive one or more fingers of an average human hand for securely grasping and lifting the weight plate.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
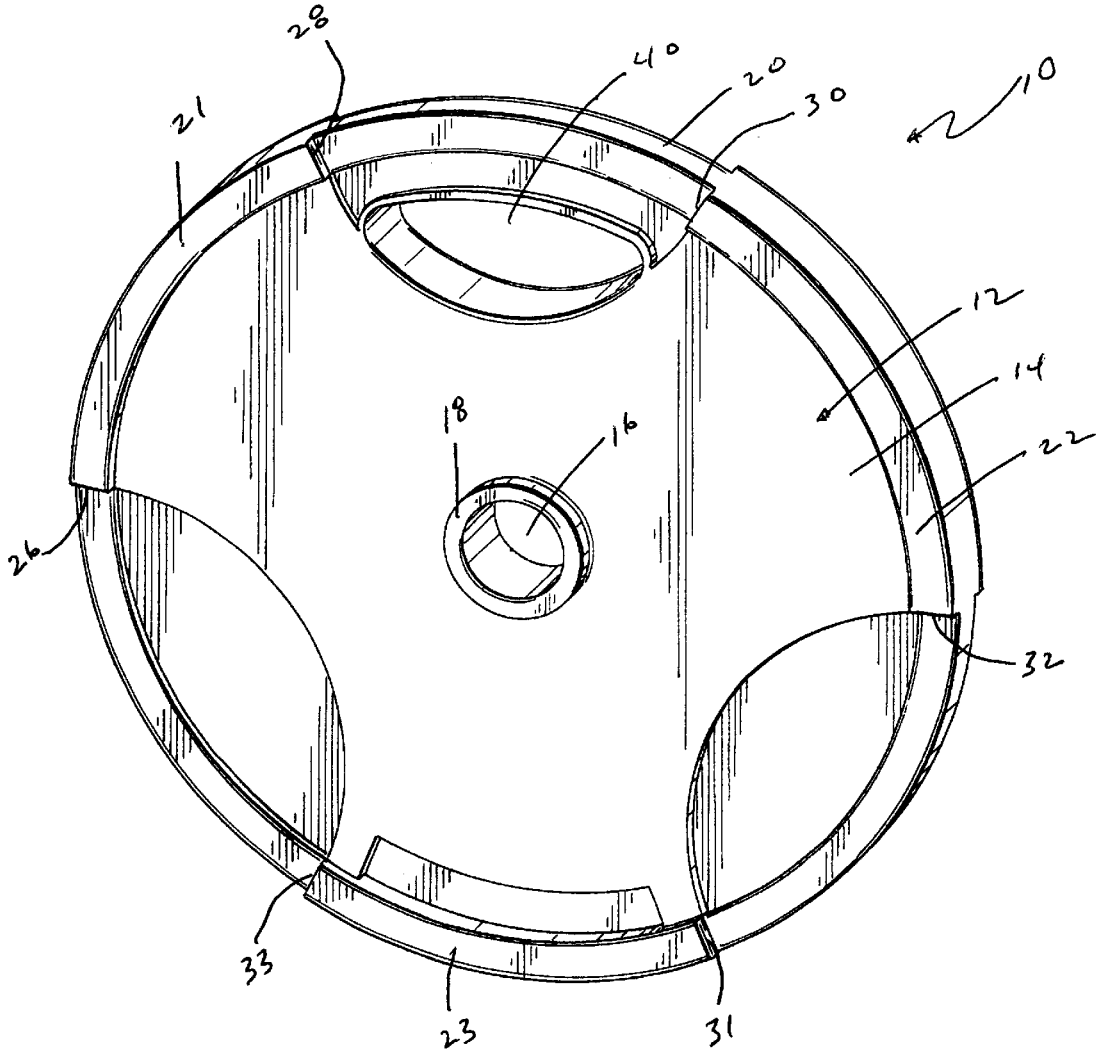
FIG. 1 is a perspective view of the weight plate of the invention.
Figure 3:
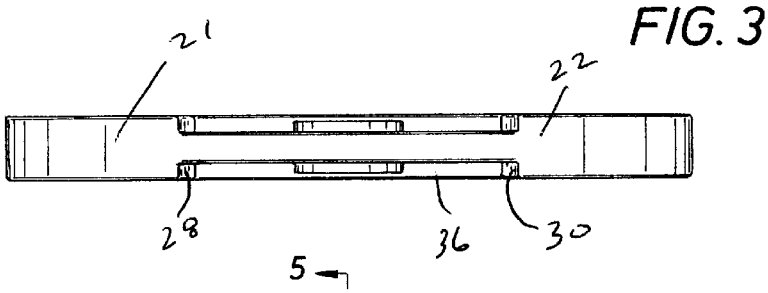
FIG. 3 is an edge view of the weight plate of the invention looking at the top of the weight plate shown in FIG. 2.
Figure 2:
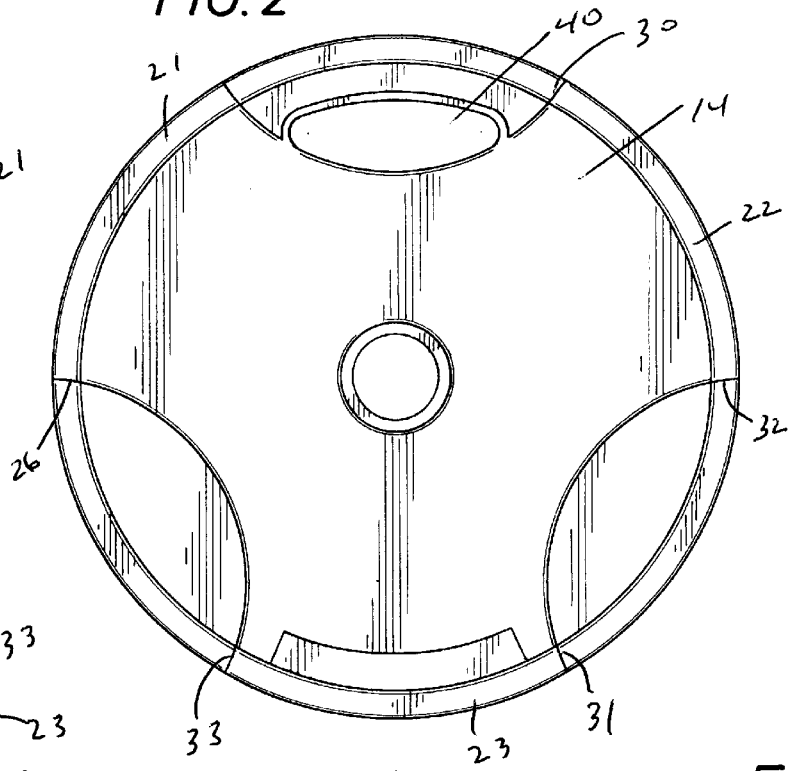
FIG. 2 is a plan view of the weight plate of the invention.
Figure 4:
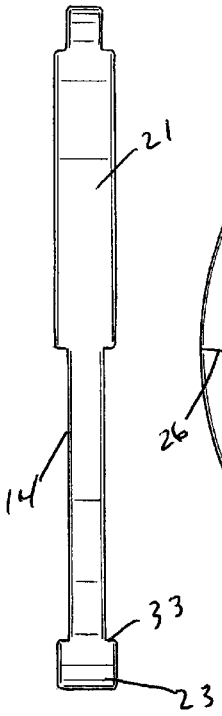
FIG. 4 is an edge view of the weight plate of the invention looking at the side of the weight plate shown in FIG. 2.
Figure 5:
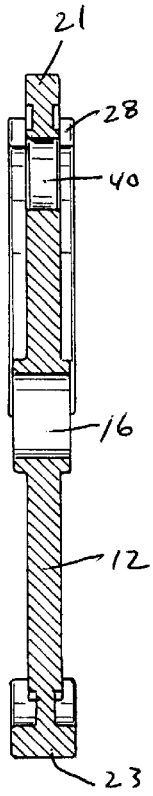
FIG. 5 is a section view of the weight plate of the invention taken along line 5—5 of FIG. 2.
Figure 6:
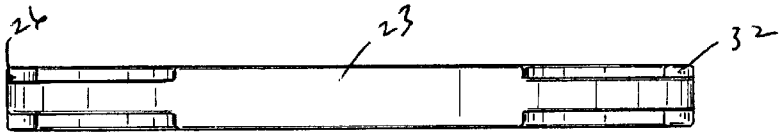
FIG. 6 is an edge view of the weight plate of the invention looking at the bottom of the weight plate shown in FIG. 2.

Referring first to FIG. 1, the weight plate of the invention is generally identified by the reference numeral 10. The weight plate 10 may be cast, rubber coated and/or polyurethane coated. The weight plate 10 includes a substantially flat body 12 defined by first and second planar surfaces 14. The planar surfaces 14 are generally opposed and define the thickness of the plate 10. A centrally located bore 16 defines the rotational axis of the plate 10 and is adapted to receive a mounting member, such as a barbell or weight bar. The bore 16 is further defined by integrally formed collars 18 which circumscribe the bore 16 and project outwardly from the surfaces 14 of the weight plate body 12. The collars 18 are oriented perpendicular to the body surfaces 14 and add axial length to the bore 16. It is understood that the diameter of the bore 16 may vary to accommodate the diameter of a barbell or dumbbell bar to be received through the bore 16. The diameter of the bore 16 will generally vary between 1 to 2 inches to accommodate most standard barbell bars.

Referring still to FIG. 1, the opposed planar surfaces 14 of the plate body 12 terminate at a circular outer periphery of the plate body 12. The outer periphery of the plate body 12 is defined by a continuous end surface 20 which extends between the plate body surfaces 14, thereby defining the thickness of the plate body 12. The weight plate 10 further includes flange members 21, 22 and 23 integrally formed therewith and forming a portion of the outer periphery of the plate body 12. The flange members 21, 22 and 23 extend in opposite direction outwardly from the opposed planar surfaces 14 of the plate body 12. The flange member 21 extends partially about the plate body 12 beginning at a first end 26 and terminating at a second end 28. Likewise, the flange member 22 extends partially about the plate body 12 beginning at a first end 30 and terminating at a second end 32, and the flange member 23 likewise beginning at a first end 31 and terminating at a second end 33.

The flange members 21, 22 and 23 are spaced from each other defining gaps 36 therebetween. The gaps 36 are dimensioned so that one or more fingers of a human hand can be radially extended through the gaps 36 for engaging the bottom flat surface 14 of the weight plate 10.

In the preferred embodiment of the invention shown in FIG. 1, the weight plate body 12 includes an opening 40 formed in the weight plate 10. The opening 40 is disposed adjacent the peripheral edge of the weight plate body 12 between one or more of the gaps 36 defined between the flange members 21, 22 and 23.

The opening 40 is sized to accommodate one or more fingers of a human hand extending through the opening 40 and wrapped around the peripheral edge of the weight plate body 12. For example, the opening 40 in the weight plate 10 shown in FIG. 1 is sized to receive at least four fingers of a human hand extending therethrough. The opening 40 provides sufficient clearance so that the knuckles of the fingers do not hit or scrape against the inner surface 42 of the opening 40. Sharp edges are eliminated by rounding the edges of the openings 40. Likewise, the perimeter flange members 21, 22 and 23 are rounded to avoid scratching or gouging the floor or harming the user in the event the weight plate 10 is brushed against the user's body.

Figure 7:
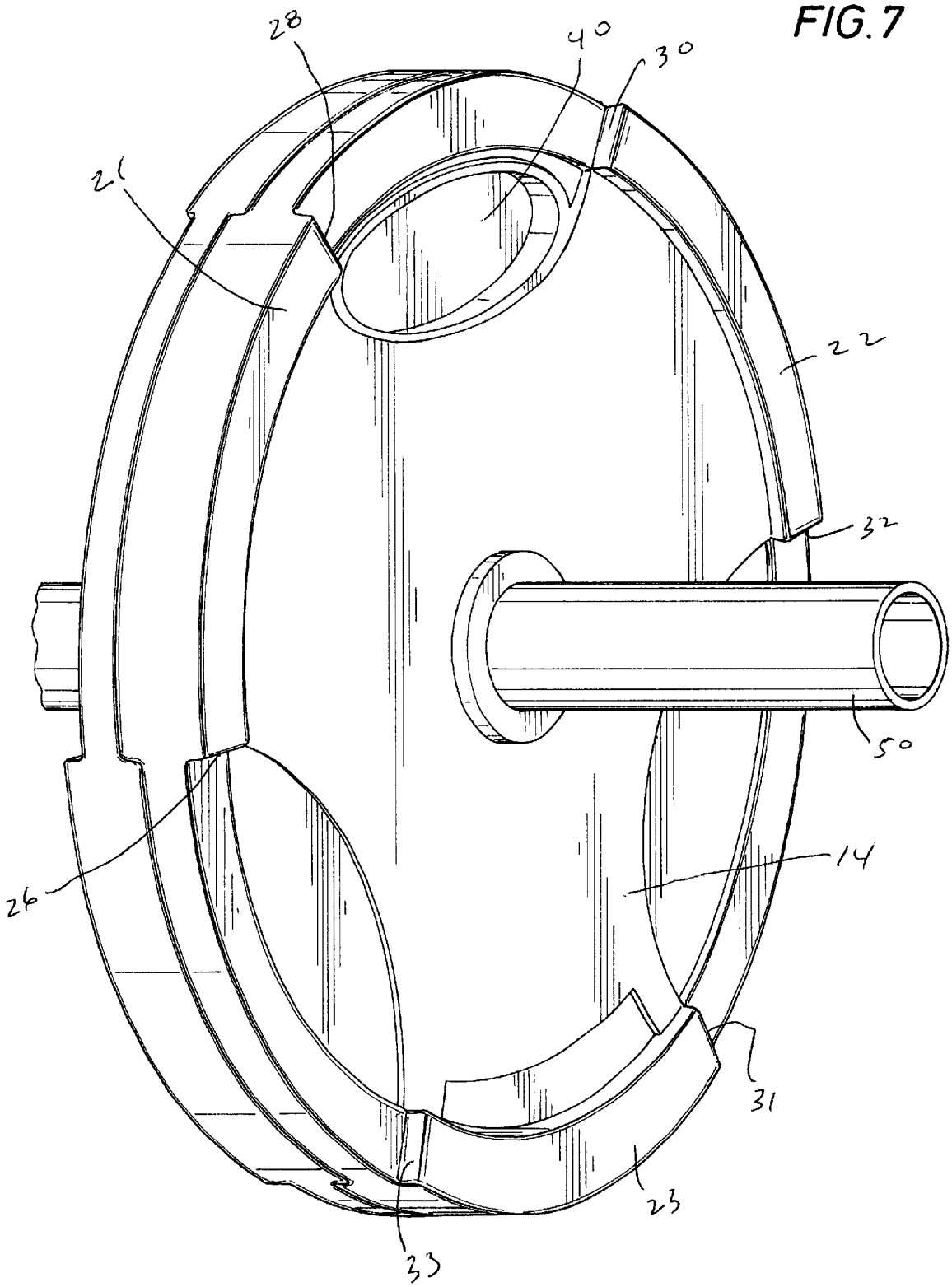
FIG. 7 is a perspective of weight plates of the invention mounted on a barbell bar in interlocking engagement.
Figure 8:
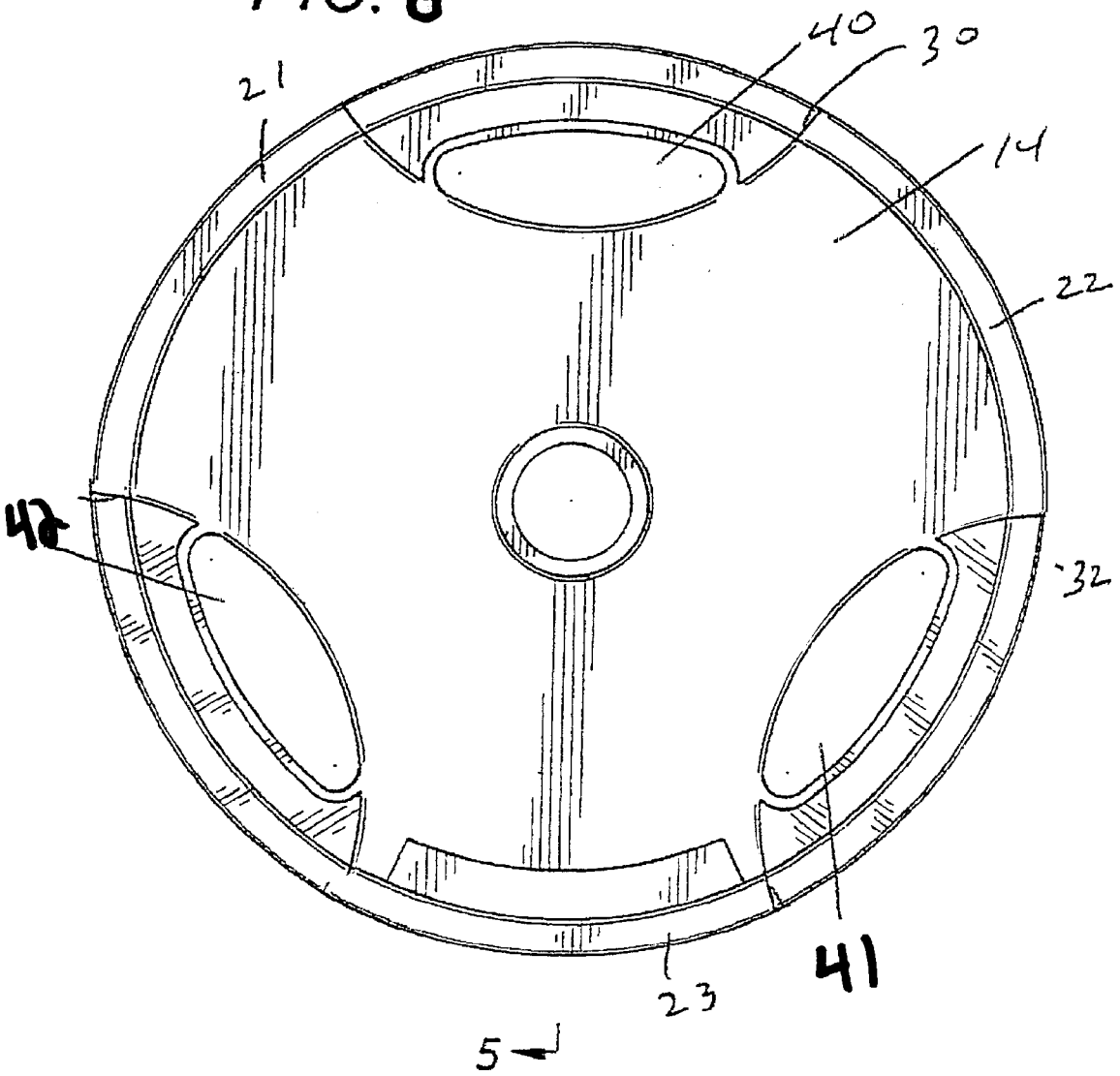
FIG. 8 is another plan view of the weight plate of the invention.

Referring now to FIG. 7, weight plates 10 of the invention are shown in interlocking engagement mounted on a weight bar 50. It will be observed that the depth of the gaps 36 is substantially equal to the height of the flange members 21, 22 and 23 extending above the planar surfaces 14 of the weight plate body 12. Additionally, the width of the gaps 36 is slightly greater than the width of the flange members 21, 22 and 23 so that they may extend into the gaps 36 when aligned therewith. In this manner, the weight plates 10 are mounted in interlocking facing contact on the weight bar 50. The weight plates 10 are thereby mounted on the weight bar 50 without play or relative rotation between adjacent weight plates 50.

The weight plate 10 of the present invention overcomes disadvantages associated with lifting known disc-shaped weights. When the weight plates 10 are on a flat surface or stacked on each other, the flange members 21, 22 and 23 support the weight plate body 12 above the support surface so that the user may extend his fingers through the opening 40 and wrap his thumb around the peripheral edge 20 of the weight plate 10. By holding the weight plate 10 in this fashion, a user may securely grip the weight plate 10 and lift it off the support surface and mount it on a barbell or dumbbell.

While a preferred embodiment of the invention has been shown and described, other and further embodiments of the invention may be devised without departing from the basic scope thereof, and the scope thereof is determined by the claims which follow.

What is claimed is:

1. A weight plate for mounting on a barbell or dumbbell, comprising:

a) a weight plate body having a perimeter and a central bore extending through said plate body;

b) at least two flange members extending partially about the perimeter of said plate body, wherein each of therefore said flange members include upstanding portions that project outwardly in opposite directions from said plate body and terminal ends spaced from each other and defining open gaps between the terminal ends; and c) one or more openings extending through said plate body, each of the one or more openings disposed adjacent the perimeter of said body in alignment with an open gap; and wherein the flange members are sized to extend into the open gaps of another of said weight plate to provide interlocking engagement of the weight plates.

2. The weight plate of claim 1, wherein the depth of the open gaps is substantially equal to the height of the flange members.

3. The weight plate of claim 1, wherein the width of the open gaps is greater than the width of the flange members.

4. The weight plate of claim 1, wherein the interlocking engagement prevents relative rotation between the weight plates.

5. The weight plate of claim 1, characterized by the plate bodies of the weight plates having a space therebetween.

6. The weight plate of claim 1, wherein interlocking engagement of the weight plates provides separation between the plate bodies of the weight plates.

7. The weight plate of claim 6, wherein the separation is substantially equal to the height of the flange.

8. The weight plate of claim 1, wherein the weight plate is cast, rubber coated or polyurethane coated.

9. The weight plate of claim 1, wherein the bore includes an integrally formed collar adding axial length to the bore.

10. The weight plate of claim 1, wherein the one or more openings include edge surfaces which are rounded.

11. The weight plate of claim 1, wherein the flange members are equally spaced about the perimeter of said weight plate body.

12. The weight plate of claim 1, wherein the weight plate comprises two openings.

13. The weight plate of claim 1, wherein the weight plate comprises three or more openings.

14. The weight plate of claim 1, wherein there is an opening positioned adjacent each open gap.

15. The weight plate of claim 1, wherein there is an opening positioned adjacent fewer than each open gap.

16. A weight plate for mounting on a barbell or dumbbell, comprising:

a) a weight plate body having a central bore extending through said weight plate body;

b) at least two radially extending flange members extending partially about the perimeter of said weight plate body, wherein each of said flange members include upstanding portions which project outwardly in opposite directions from said plate body said flange members defining gaps there between;

c) at least one opening disposed adjacent the perimeter of said body generally aligned with at least one of said gaps; and d) wherein said flange members are adapted for locking adjacent weight plates against relative rotation.

17. A weight plate for mounting on a barbell, comprising:

a body in a first plane, said body having an outer perimeter and said body having an inner bore extending through for coupling to said barbell;

at least two flange members, each having a first dimensional component in a plane perpendicular to said first plane, said first dimensional component entirely existing in an area proximate to said outer perimeter, at least one opening extending through said plate and adjacent to said outer perimeter wherein at least a portion of said at least one opening is substantially aligned with at least a portion of a gap defined between two of said flange members;

wherein said flange members are adapted for locking adjacent weight plates against relative rotation.

18. A weight plate for mounting on a barbell or dumbbell, comprising:

a) a weight plate body having a central bore extending through said weight plate body;

b) at least two flange members extending partially about the perimeter of said weight plate body, wherein said flange members include upstanding portions which project outwardly in opposite directions from said plate body;

c) at least one opening disposed adjacent the perimeter of said body and not disposed entirely within a flange member wherein at least a grippable portion of said at least one opening is substantially aligned with a gap defined between two of said flange members; and d) wherein said flange members are adapted for locking adjacent weight plates against relative rotation.

* * * * *